US008707930B2

(12) United States Patent
Bolz et al.

(10) Patent No.: US 8,707,930 B2
(45) Date of Patent: Apr. 29, 2014

(54) HOLD-DOWN DEVICE FOR A FUEL INJECTION DEVICE

(75) Inventors: Thilo Bolz, Kraichtal (DE); Thomas Fuerst, Clayton (AT)

(73) Assignee: Robert Bosch GmbH, Stuttgart (DE)

( * ) Notice: Subject to any disclaimer, the term of this patent is extended or adjusted under 35 U.S.C. 154(b) by 691 days.

(21) Appl. No.: 12/736,951

(22) PCT Filed: Apr. 7, 2009

(86) PCT No.: PCT/EP2009/054137

§ 371 (c)(1),
(2), (4) Date: Apr. 7, 2011

(87) PCT Pub. No.: WO2009/144069

PCT Pub. Date: Dec. 3, 2009

(65) Prior Publication Data

US 2011/0186016 A1 Aug. 4, 2011

(30) Foreign Application Priority Data

May 30, 2008 (DE) ..... 10 2008 002 122

(51) Int. Cl.
*F02M 61/14* (2006.01)

(52) U.S. Cl.
USPC ..... 123/470

(58) Field of Classification Search
USPC ..... 123/469, 470
See application file for complete search history.

(56) References Cited

U.S. PATENT DOCUMENTS

| | | | | |
|---|---|---|---|---|
| 4,307,693 | A | 12/1981 | Glöckler et al. | |
| 5,074,269 | A * | 12/1991 | Herbon et al. | 123/470 |
| 5,501,195 | A | 3/1996 | Hall | |
| 7,063,075 | B2 * | 6/2006 | Berger et al. | 123/470 |
| 7,607,418 | B2 * | 10/2009 | Abe et al. | 123/470 |
| 7,802,559 | B2 * | 9/2010 | Furst et al. | 123/470 |
| RE43,864 | E * | 12/2012 | Watanabe et al. | 123/470 |
| 2007/0175450 | A1 | 8/2007 | Eckbauer et al. | |
| 2007/0266996 | A1 * | 11/2007 | Zdroik et al. | 123/445 |

FOREIGN PATENT DOCUMENTS

| | | |
|---|---|---|
| CN | 1478176 | 2/2004 |
| DE | 29 26 490 | 2/1981 |
| DE | 101 08 193 | 8/2002 |
| DE | 10 2004 048 401 | 4/2006 |
| WO | WO 03/054383 | 7/2003 |
| WO | WO 2005/083262 | 9/2005 |

* cited by examiner

*Primary Examiner* — Stephen K Cronin
*Assistant Examiner* — Elizabeth Hadley
(74) *Attorney, Agent, or Firm* — Kenyon & Kenyon LLP

(57) ABSTRACT

The hold-down device for a fuel injection device has a design which is simple in particular, which nonetheless enables a fuel injector (1) to be held down very effectively. The fuel injection device includes at least one fuel injector (1), a receptacle bore for the fuel injector (1) and a connecting fitting (6) of a fuel distributor line (4), the hold-down device (10) being clamped between a shoulder (12) of the fuel injector (1) and an end surface (14) of the connecting fitting (6). The hold-down device (10) has a base element (11) in the shape of a partial ring, from which an axially flexible hold-down clip (13) extends in a bent-away fashion, the clip having at least two webs (21), two oblique segments (22), and two contact segments (23). The fuel injector (1) is suitable in particular for use in fuel injection systems of mixture-compressing, externally ignited internal combustion engines.

20 Claims, 3 Drawing Sheets

HOLD-DOWN DEVICE FOR A FUEL INJECTION DEVICE

BACKGROUND OF THE INVENTION

1. Field of the Invention

The present invention is directed to a hold-down device for a fuel injection device.

2. Description of Related Art

Published German patent application document DE 29 26 490 A1 already describes a fastening device for fastening a fuel injector to an intake manifold, in which the fuel injector is axially fixed to the fuel distributor line or to a plug nipple via a fastening element designed in the form of a U-shaped securing bracket which is provided with two legs that are flexible in the radial direction. In the assembled state, the securing bracket engages through corresponding openings in the plug nipple, and is capable of snapping into a recess, designed as an annular groove, in a connecting fitting of the fuel injector. The axial play between the recesses and the securing bracket, as well as between the annular groove and the securing bracket, should be kept small in order to achieve a precise fixing of the fuel injector without stressing the seal.

A disadvantage of the fastening device known from published German patent application document DE 29 26 490 A1 is in particular the stressing effect of the various holding parts on the fuel injector. The flow of force that is produced in the fuel injector results in deformations, and thus in changes in the lift of the valve needle, up to the point of jamming, and to a compressive or flexing load on the housing parts, which in general have thin walls and are welded to one another at various points. In addition, each fastening measure, using for example a bearing collar, results in an increase in the radial extension of the fuel injector, and thus in an increased space requirement during installation.

Published German patent application document DE 101 08 193 A1 describes a fastening device for the mutual fastening of a fuel injector in a cylinder head of an internal combustion engine, and of the fuel injector to a fuel distributor line. The fastening device has a sleeve that is clamped between a shoulder of the fuel distributor line and a shoulder of the fuel injector and is made of an elastic material. Due to its tubular structure, the sleeve may transmit the hold-down forces to the fuel injector with only limited effectiveness. The surfaces, loaded by the shoulders of the fuel injector and the fuel distributor line, of the sleeve used as the hold-down device represent the cut edges that result from the process of manufacturing the sleeve blank.

Various designs of hold-down devices are also known from published German patent application document DE 10 2004 048 401 A1, to which reference is made for better understanding of the present invention based on FIGS. 1 through 3 below.

SUMMARY OF THE INVENTION

The hold-down device of the present invention for a fuel injection device has the advantage that in particular it has a simple design, is very simple and economical to manufacture, and nonetheless achieves a very effective holding down of a fuel injector in a receptacle bore of a cylinder head or of an intake manifold. Using conventional manufacturing methods, such as stamping, eroding, or laser cutting, blanks for the eventual hold-down device may be detached from sheets of spring steel or stainless steel, and may be brought into numerous fairly complex desired shapes through bending. The specific embodiment of the hold-down device according to the present invention is in particular distinguished by its compact design so that the necessary radial installation space, especially in the area of passage of the connecting plug of the fuel injector, is extremely small.

The hold-down device according to the present invention, which does not have rotationally fixing means, makes a more precise orientation of the fuel injector possible compared to known hold-down devices having integrated rotationally fixing elements, because the component tolerances of the hold-down device for the rotational fixing are dispensed with in the design according to the present invention. In addition, the hold-down device may compensate for greater axial tolerances than is possible with known hold-down devices. Primarily, the above-indicated advantages result, in particular, in connection with the fuel injection device having a simple rotational fixing.

It is advantageous to design the hold-down device as a stamped bent part, and to shape it and to install it in a fuel injection device in such a way that the surfaces of the oblique segments and contact segments of the hold-down device that are under bending stress run perpendicular to the cut edges that result when the blank for the hold-down device is detached from the corresponding sheet metal. In this way, the long-term load-bearing capacity of the segments, stressed to the point of bending, of the hold-down clip of the hold-down device may be increased, and an optimal hold-down force, exerted on the fuel injector so as to fix it securely in the receptacle bore, may be achieved.

It is advantageous in particular to provide the hold-down device, seen in the circumferential direction, with an open area in such a way that the open area is penetrated by the connecting plug of the fuel injector, so that an unambiguous installation position is defined for the hold-down device. Rotational fixing of the hold-down device in relation to the connecting fitting is dispensed with, due to the cog/recess pairing on the fuel injector/connecting fitting. The hold-down device is mounted on the fuel injector in such a way that a hold-down clip, under bending stress, is oriented away from the connecting plug of the fuel injector.

BRIEF DESCRIPTION OF DRAWINGS

An exemplary embodiment of the present invention is depicted in the drawing in simplified fashion and is explained in greater detail in the following description.

DETAILED DESCRIPTION OF THE INVENTION

Figure 1:
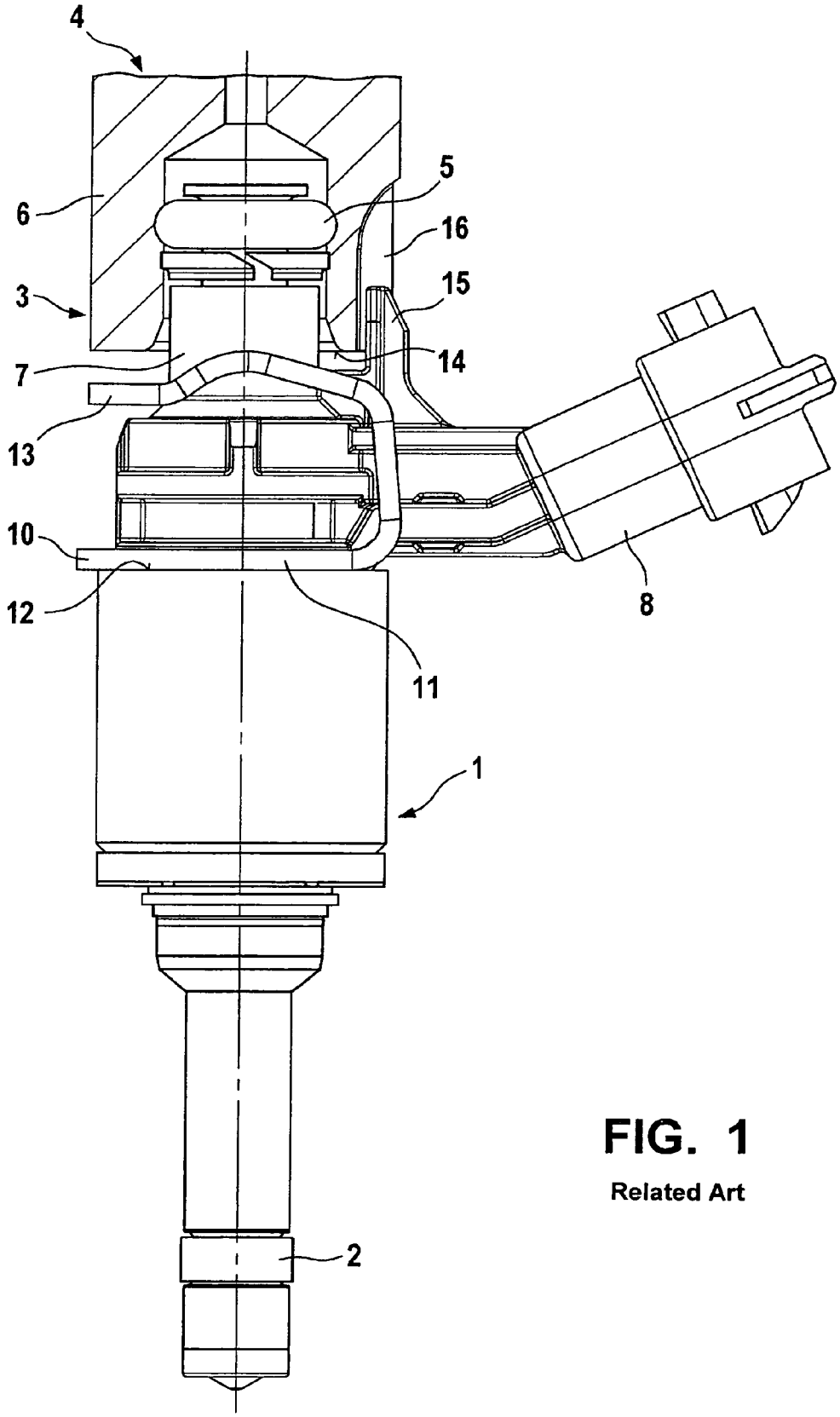
FIG. 1 Related Art
FIG. 1 shows a partial representation, in a side view, of a fuel injection device having a known first hold-down device.

A valve in the form of a fuel injector 1 for fuel injection systems of mixture-compressing, externally ignited internal combustion engines is shown in FIG. 1 as a known example. Fuel injector 1 is part of a fuel injection device. A downstream end of fuel injector 1, designed in the form of a direct-injecting fuel injector for the direct injection of fuel into a combustion chamber of the internal combustion engine, is installed in a receptacle bore of a cylinder head (not shown). A sealing ring 2, made in particular of Teflon®, provides an optimal sealing of fuel injector 1 in relation to the wall of the cylinder head. The valve receptacle may likewise be provided on a receptacle fitting of an intake manifold (not shown).

On its end 3 at the inflow side, fuel injector 1 has a plug connection to a fuel distributor line 4, sealed by a sealing ring 5 between a connecting fitting 6 of fuel distributor line 4, shown in section, and an inflow fitting 7 of fuel injector 1. Fuel injector 1 has an electrical connecting plug 8 for the electrical contacting for actuating fuel injector 1.

In order to hold fuel injector 1 and fuel distributor line 4 at a distance from one another without radial forces, and to hold fuel injector 1 down securely in the receptacle bore of the cylinder head or intake manifold, according to the present invention a hold-down device 10 is provided between fuel injector 1 and connecting fitting 6. Hold-down device 10 is designed as a clip-type component; e.g., a stamped bent part. Hold-down device 10 has a base element 11 in the shape of a partial ring, this base element 11, which does not extend over 360° but instead extends over only approximately 250° to 320°, being supported on a shoulder 12 of fuel injector 1. With a hold-down clip 13 that is bent away from flat base element 11 and is axially resilient, hold-down device 10, in its assembled state, lies against a downstream end surface 14 of connecting fitting 6 on fuel distributor line 4. In the area of electrical connecting plug 8, hold-down device 10 is interrupted, this known hold-down device 10 forming a closed clip element as is illustrated in particular in FIG. 2. In this way, hold-down device 10 is able to surround fuel injector 1, while nonetheless enabling electrical connecting plug 8 to protrude through. The resilient clips of hold-down clip 13 extend away from connecting plug 8.

In the area of transition from electrical connecting plug 8 to the plastic extrusion coating at least partly surrounding fuel injector 1 in the area of inflow fitting 7, on fuel injector 1 a pin-shaped raised cog 15 is provided that corresponds to a groove-type indentation or recess 16 on connecting fitting 6 of fuel distributor line 4. Cog 15, extending into recess 16, of fuel injector 1 provides a direct and therefore very secure rotational fixing of fuel injector 1 in relation to fuel distributor line 4, and a reliable definition of the rotational position of hold-down device 10 with respect to fuel injector 1. On the other hand, hold-down device 10 makes a more precise orientation of fuel injector 1 possible compared to known hold-down devices having integrated rotationally fixing elements, because the component tolerances of hold-down device 10 for rotational fixing are dispensed with due to this design.

Figure 2:
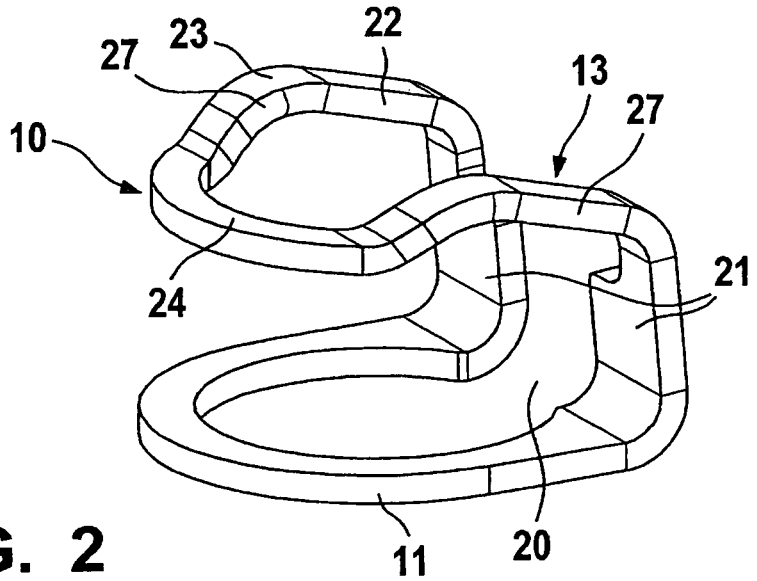
FIG. 2 Related Art
FIG. 2 shows the hold-down device used in the fuel injection device according to FIG. 1 as a single component.

Hold-down device 10 used in the fuel injection device according to FIG. 1 is shown once more as a single component in FIG. 2. Hold-down device 10 is distinguished in that at least one bent, axially resilient hold-down clip 13 extends out from the plane of base element 11 starting from a flat base element 11 in the shape of a partial ring. Base element 11 is in the form of a clasp and surrounds fuel injector 1 in the area of its end 3 at the inflow side. In hold-down device 10 shown in FIG. 2, base element 11 is designed to be flat, e.g., having a thickness of approximately 1.5 mm, so that a large support surface is present on shoulder 12.

From base element 11, two webs 21 having enlarged widths extend largely in the axial direction, and thus largely perpendicular to the plane of extension of base element 11. These webs 21 are bent in their transition to the actual axially flexible hold-down clip 13, this hold-down clip 13 being made up of three essential segments. Starting from webs 21, hold-down clip 13 has only a small axial extension resulting from two oblique segments 22 that have the same shape. Oblique segments 22 make a transition into slightly curved contact segments 23, which finally, in the installed state, make contact with end surface 14 of connecting fitting 6. Between contact segments 23, a connecting segment 24 is created that is slightly lowered in relation to contact segments 23 and ensures that the overall hold-down device 10 is closed.

Figure 3:
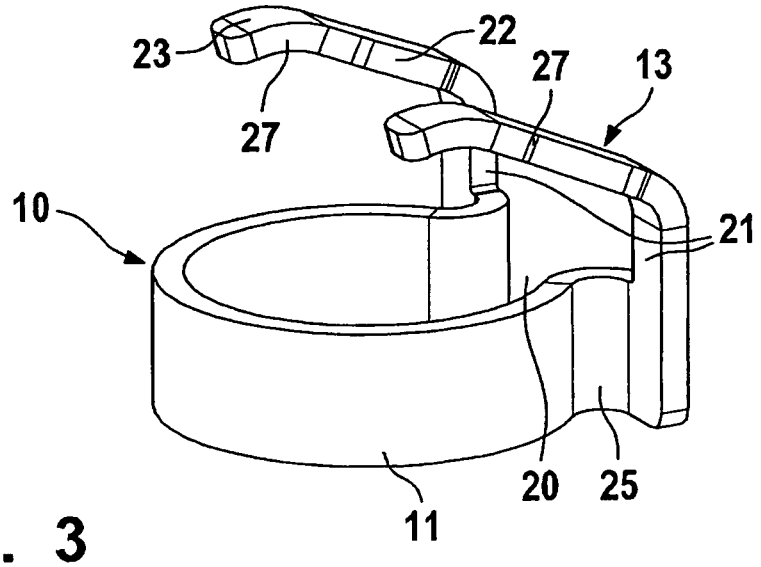
FIG. 3 Related Art
FIG. 3 shows a known second specific embodiment of a hold-down device.

In contrast to previously described hold-down device 10, an also known hold-down device 10 according to FIG. 3 does not have a connecting segment 24, so that overall an open hold-down device 10 is present. From base element 11, two webs 21 again extend largely in the axial direction, and thus largely perpendicular to the plane of extension of base element 11. With respect to their wall thickness, webs 21 are twisted in relation to base element 11, it being possible for transition area 25 to be rotated outwardly. Webs 21 are bent in their transition to the actual axially flexible hold-down clip 13, hold-down clip 13 being made up of two segments in each case. Starting from webs 21, hold-down clips 13 have only a small axial extension resulting from two oblique segments 22 that have the same shape. Oblique segments 22 make a transition into slightly curved contact segments 23, which finally, in the installed state, make contact with end surface 14 of connecting fitting 6. Base element 11 of hold-down device 10 has an upright construction and has, e.g., again a wall thickness of approximately 1.5 mm.

Figure 4:
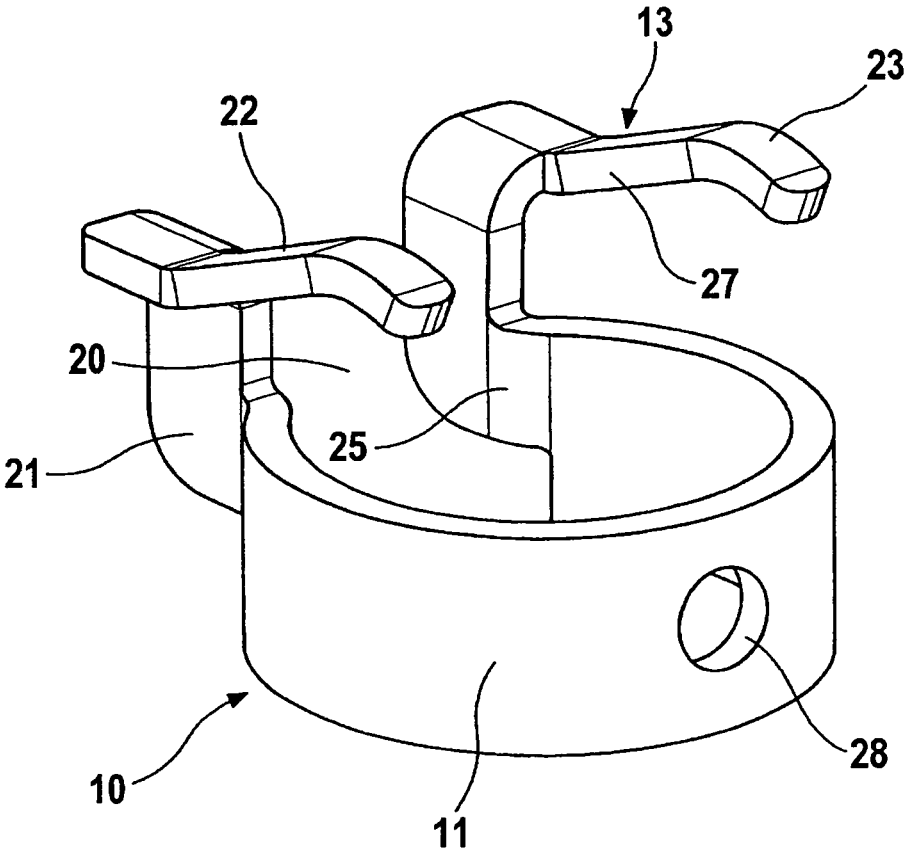
FIG. 4 shows a specific embodiment of a hold-down device according to the present invention.

One specific embodiment of a hold-down device 10 according to the present invention is shown in FIG. 4. Starting from a base element 11 standing upright, two transition areas 25 join on the side of open area 20 which is penetrated by connecting plug 8 of fuel injector 1, which from the direction of the sheet metal continue to run upright but at the same time largely parallel to one another. Without twisting, transition areas 25 make a transition into two webs 21 that are also aligned largely parallel to one another and extend from the plane of base element 11. As no twisting takes place in transition areas 25, the wide sides of the two webs 21 of this sheet metal segment are opposite from one another and not their cut edges 27 that are produced when they are detached from the sheet metal. On the end of webs 21 facing away from base element 11, the webs are, however, twisted or bent 90°, e.g., to the outside, as shown in FIG. 4. Two oblique segments 22 of the same shape extend rising axially further away from these bent end areas of webs 21 of hold-down clip 13. Oblique segments 22 run parallel to one another, the rotation now causing cut edges 27 to be opposite one another and back again seen in the direction from open area 20. Oblique segments 22 make a transition into slightly curved contact segments 23, which finally, in the installed state, make contact with end surface 14 of connecting fitting 6 and end separate from one another. Hold-down device 10 again has a wall thickness of approximately 1.5 mm.

Hold-down device 10 is removed from sheets of spring steel or stainless steel (having a thickness of approximately 1.5 mm), e.g., by stamping, eroding, or laser cutting and is later brought into the desired shape by bending.

An opening 28 provided in base element 11 may be used as a transport receptacle during the production operation and has no influence on the actual hold-down function.

What is claimed is:

1. A hold-down device for a fuel injection device, the fuel injection device including at least one fuel injector, a receptacle bore for the fuel injector and a connecting fitting of a fuel distributor line, wherein it is possible to clamp the hold-down device between a shoulder of the fuel injector and an end surface of the connecting fitting, the hold-down device comprising: a base element in the shape of a partial ring, from which an axially flexible hold-down clip extends, the clip having at least two webs, two oblique segments, and two contact segments, and the base element being designed as a partial ring standing upright, whose wall thickness corresponds to the thickness of the sheet metal used, wherein the base element makes a transition into the two webs of the hold-down clip in such a way that the sheet metal wide sides of the webs extending out from the plane of the base element are opposite from one another and the ends of the webs facing away from the base element are bent in such a way that the oblique segments extend out from the bent end areas of the webs in such a way that the cut edges are now opposite from one another in the sheet metal.

2. The hold-down device as recited in claim 1, wherein the base element of the hold-down device may be placed into contact with the shoulder of the fuel injector.

3. The hold-down device as recited in claim 1, wherein the contact segments of the hold-down clip may be placed into contact with the end surface of the connecting fitting.

4. The hold-down device as recited in claim 2, wherein the contact segments of the hold-down clip may be placed into contact with the end surface of the connecting fitting.

5. The hold-down device as recited in claim 1, wherein surfaces, under bending stress, of the oblique segments and contact segments run perpendicular to the cut edges that result when the blank for the hold-down device is removed from the corresponding sheet metal.

6. The hold-down device as recited in claim 2, wherein surfaces, under bending stress, of the oblique segments and contact segments run perpendicular to the cut edges that result when the blank for the hold-down device is removed from the corresponding sheet metal.

7. The hold-down device as recited in claim 3, wherein surfaces, under bending stress, of the oblique segments and contact segments run perpendicular to the cut edges that result when the blank for the hold-down device is removed from the corresponding sheet metal.

8. The hold-down device as recited in claim 1, wherein it is designed as a stamped bent part.

9. The hold-down device as recited in claim 2, wherein it is designed as a stamped bent part.

10. The hold-down device as recited in claim 3, wherein it is designed as a stamped bent part.

11. The hold-down device as recited in claim 5, wherein it is designed as a stamped bent part.

12. The hold-down device as recited in claim 1, wherein the sheet metal used for the hold-down device is made of spring steel or stainless steel.

13. The hold-down device as recited in claim 2, wherein the sheet metal used for the hold-down device is made of spring steel or stainless steel.

14. The hold-down device as recited in claim 3, wherein the sheet metal used for the hold-down device is made of spring steel or stainless steel.

15. The hold-down device as recited in claim 5, wherein the hold-down device has a wall thickness of approximately 1.5 mm, corresponding to the sheet thickness used.

16. The hold-down device as recited in claim 12, wherein the hold-down device has a wall thickness of approximately 1.5 mm, corresponding to the sheet thickness used.

17. The hold-down device as recited in claim 1, wherein the two contact segments of the hold-down clip terminate it so that the hold-down device is open.

18. The hold-down device as recited in claim 2, wherein the two contact segments of the hold-down clip terminate it so that the hold-down device is open.

19. The hold-down device as recited in claim 1, wherein end areas of webs facing away from the base element are bent outward in order to make a transition from there into the oblique segments.

20. The hold-down device as recited in claim 2, wherein end areas of webs facing away from the base element are bent outward in order to make a transition from there into the oblique segments.

* * * * *

UNITED STATES PATENT AND TRADEMARK OFFICE

CERTIFICATE OF CORRECTION

PATENT NO. : 8,707,930 B2
APPLICATION NO. : 12/736951
DATED : April 29, 2014
INVENTOR(S) : Bolz et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 821 days.

Signed and Sealed this
Twenty-ninth Day of September, 2015

Michelle K. Lee

Michelle K. Lee
*Director of the United States Patent and Trademark Office*